US010890003B2

(12) United States Patent
Gardner et al.

(10) Patent No.: US 10,890,003 B2
(45) Date of Patent: Jan. 12, 2021

(54) LINER REMOVAL APPARATUS

(71) Applicant: International Chimney Corporation, Williamsville, NY (US)

(72) Inventors: George R. Gardner, East Amherst, NY (US); Edmund P. Gasiecki, Cheektowaga, NY (US)

(73) Assignee: International Chimney Corporation, Williamsville, NY (US)

( * ) Notice: Subject to any disclaimer, the term of this patent is extended or adjusted under 35 U.S.C. 154(b) by 633 days.

(21) Appl. No.: 15/381,730

(22) Filed: Dec. 16, 2016

(65) Prior Publication Data

US 2018/0171652 A1 Jun. 21, 2018

(51) Int. Cl.
*E04G 23/08* (2006.01)

(52) U.S. Cl.
CPC ..... *E04G 23/08* (2013.01); *E04G 2023/087* (2013.01)

(58) Field of Classification Search
CPC ... E04G 23/08; E04G 2023/087; E04G 3/246; F16M 3/00; F27D 1/1694; B08B 9/053; B08B 9/055; F16L 55/26; F16L 55/28; F16L 55/32; F16L 55/34; F16L 55/36; F16L 55/38; F16L 55/40; F16L 55/44; B25G 3/26; B25G 3/12; B25G 1/04; E02F 9/18
USPC ..... 173/185, 35; 15/104.07, 104.05; 137/15.07
See application file for complete search history.

(56) References Cited

U.S. PATENT DOCUMENTS 1,569,203 A * 1/1926 Rice ..... B08B 9/087 15/104.069
2,170,660 A * 8/1939 Langmyhr ..... C10G 9/16 15/104.096
2,710,418 A * 6/1955 Putnam ..... E04G 23/008 15/104.07
3,302,976 A * 2/1967 Grant ..... C21B 7/06 15/104.07
3,370,888 A * 2/1968 Skendrovic ..... F27D 1/1694 173/196
3,436,120 A * 4/1969 Armstrong ..... E04G 3/24 299/70
4,597,473 A * 7/1986 Peck ..... A01M 31/02 108/152

(Continued)

*Primary Examiner* — Thanh K Truong
*Assistant Examiner* — Katie L Gerth
(74) *Attorney, Agent, or Firm* — Simpson & Simpson, PLLC; Michael Nicholas Vranjes

(57) ABSTRACT

A chimney liner removal apparatus including a main chassis, a first telescoping front arm, a second telescoping front arm, a rear telescoping arm, a movable mass and an extendible excavator. The first telescoping front arm is fixedly connected to the main chassis and includes a first hollow member and a first extendible member within the first hollow member. The second telescoping front arm is fixedly connected to the main chassis and includes a second hollow member and a second extendible member within the second hollow member. The rear telescoping arm is fixedly connected to the main chassis and includes a third hollow member and a third extendible member within the third hollow member. The movable balance mass is arranged on the third hollow member. The extendible excavator assembly is pivotally connected to the main chassis opposite the rear telescoping arm.

20 Claims, 6 Drawing Sheets

(56) References Cited

U.S. PATENT DOCUMENTS

| | | | | | |
|---|---|---|---|---|---|
| 4,813,313 | A * | 3/1989 | Ichikawa | B23D 45/024 | 299/70 |
| 4,955,457 | A * | 9/1990 | Pohl | E04G 23/08 | 182/128 |
| 5,012,895 | A * | 5/1991 | Santos | E06C 7/44 | 182/107 |
| 5,052,566 | A * | 10/1991 | Ziegler | B66C 23/48 | 212/257 |
| 5,179,757 | A * | 1/1993 | Grant, Jr. | B08B 9/087 | 15/104.07 |
| 5,503,033 | A * | 4/1996 | Van Niekerk | B08B 9/08 | 73/865.8 |
| 2004/0004346 | A1* | 1/2004 | Humphries | B60P 3/12 | 280/763.1 |
| 2006/0228105 | A1* | 10/2006 | Chapman | B66F 11/048 | 396/419 |
| 2009/0206589 | A1* | 8/2009 | Osswald | B62D 21/14 | 280/782 |
| 2015/0159388 | A1* | 6/2015 | Perdue | E04G 23/082 | 241/101.72 |
| 2016/0122980 | A1* | 5/2016 | Kondo | E02F 9/2296 | 414/687 |
| 2016/0200555 | A1* | 7/2016 | Shan | B66C 23/705 | 212/348 |

* cited by examiner

LINER REMOVAL APPARATUS

FIELD OF THE INVENTION

The invention broadly relates to a liner removal apparatus, more specifically to a liner removal apparatus for chimney structures, smokestacks, silos, etc., and even more particularly to a liner removal apparatus for chimney structures, smokestacks, silos, etc., arranged to alter its configuration to accommodate various structural requirements while maintaining the center of gravity of the apparatus.

BACKGROUND OF THE INVENTION

Methods for removing liners in chimneys, smokestacks, silos and the like are known in the art. For example, demolition experts may be lowered into a chimney on a scaffold system and thereafter manually remove the liner. Hand tools, power tools, chemicals, etc. may be utilized to remove a liner depending on the type of lining and materials that have passed through the chimney during its use.

Industrial chimneys are often connected to steam generating boilers or industrial furnaces. Gases from those devices are directed to the chimney via ductworks or are directly connected. Although reinforced concrete has largely replaced bricks as a structural component in the construction of industrial chimneys, refractory bricks and other materials, e.g., gunite, borosilicate block and vinyl ester resin, are often used as a lining. The type of lining is selected based on its compatibility with the materials passing through the chimney.

Some flue gases, i.e., gases moving through a chimney, are high temperature, while others may be highly acidic. Some flue gases may include particulate materials, or other aggressive chemical components. In addition to exposure to materials exiting the chimney, liners may also be exposed to common environmental materials, e.g., rain, snow, etc.

The inclusion of a liner and proper maintenance of the same protects the exterior chimney structure from corrosion and high temperatures, and may prolong the useful life of a chimney. Moreover, failure to maintain a liner in proper condition could result in failures to meet regulatory standards, e.g., Environmental Protection Agency regulations, thereby resulting in fines and downtime.

In view of the need to maintain chimney liners and the unfriendly environments wherein such liners are located, an apparatus capable of removing liners is needed. An apparatus capable of removing chimney liners that does not require workers within the chimney saves time, money and lives by decreasing maintenance times, while keeping chimney workers away from dangerous conditions. The apparatus set forth herein provides such benefits.

BRIEF SUMMARY OF THE INVENTION

The present invention broadly comprises a chimney liner removal apparatus. In some embodiments, the chimney liner removal apparatus includes a main chassis, a first telescoping front arm, a second telescoping front arm, a rear telescoping arm, a movable mass and an extendible excavator. The first telescoping front arm is fixedly connected to the main chassis and includes a first hollow member and a first extendible member within the first hollow member. The second telescoping front arm is fixedly connected to the main chassis and includes a second hollow member and a second extendible member within the second hollow member. The rear telescoping arm is fixedly connected to the main chassis and includes a third hollow member and a third extendible member within the third hollow member. The movable balance mass is arranged on the third hollow member. The extendible excavator assembly is pivotally connected to the main chassis opposite the rear telescoping arm.

In some embodiments, the chimney liner removal apparatus includes a main chassis, a first front arm fixedly connected to the main chassis, a second front arm fixedly connected to the main chassis, a rear telescoping arm, a movable balance mass, and an extendible excavator. The rear telescoping arm is fixedly connected to the main chassis and comprises a first hollow member and a first extendible member within the first hollow member. The movable balance mass is arranged on the first hollow member. The extendible excavator assembly is pivotally connected to the main chassis opposite the rear telescoping arm.

In some embodiments, the chimney liner removal apparatus includes a main chassis, a first front arm fixedly connected to the main chassis, a second front arm fixedly connected to the main chassis, a rear telescoping arm, a movable balance mass, a hydraulic cylinder, and an extendible excavator. The rear telescoping arm is fixedly connected to the main chassis and comprises a first hollow member and a first extendible member within the first hollow member. The movable balance mass is arranged on the first hollow member. The hydraulic cylinder is arranged to linearly translate the movable mass. The extendible excavator assembly is pivotally connected to the main chassis opposite the rear telescoping arm.

It is a general object of the present invention to provide a liner removal apparatus that eliminates the shortcomings of known devices.

It is another general object of the present invention to provide a liner removal apparatus that possesses increased safety and performance features over known demolition devices.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

Figure 1:
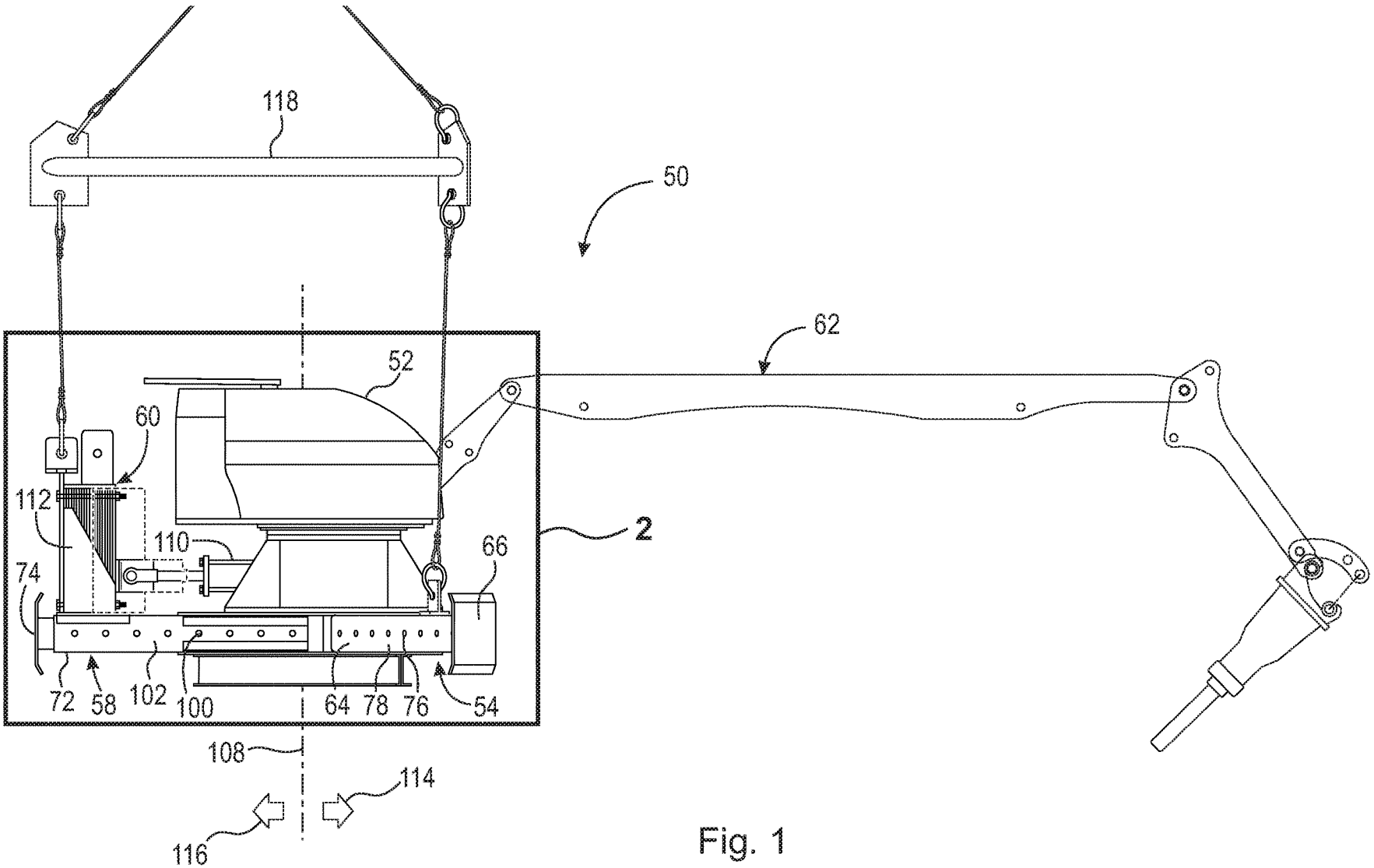
FIG. 1 is a side elevational view of an embodiment of a present invention liner removal apparatus secured to a spreader beam.

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodologies, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. As used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

The terms "chimney", "chimney structure", "smokestack", "silo" and the like, as used herein, are used interchangeably and are intended to refer to similar types of structures.

Although any methods, devices or materials similar or equivalent to those described herein can be used in the practice or testing of the invention, the preferred methods, devices, and materials are now described.

Adverting now to the figures, the accompanying figures depict various structures and functional arrangements of the present invention liner removal apparatus. Liner removal apparatus 50 comprises main chassis 52, first telescoping front arm 54, second telescoping front arm 56, rear telescoping arm 58, movable balance mass 60 and extendible excavator assembly 62. First telescoping front arm 54 is fixedly connected to main chassis 52 and comprises first hollow member 64 and first extendible member 66 within first hollow member 64. Second telescoping front arm 56 is fixedly connected to main chassis 52 and comprises second hollow member 68 and second extendible member 70 within second hollow member 68. Rear telescoping arm 58 is fixedly connected to main chassis 52 and comprises third hollow member 72 and third extendible member 74 within third hollow member 72. Movable balance mass 60 is arranged on third hollow member 72. Extendible excavator assembly 62 is pivotally connected to main chassis 52 opposite rear telescoping arm 58.

In some embodiments, at least one of first hollow member 64 or second hollow member 68 comprises a plurality of through holes, e.g., through holes 76, arranged in first side 78 or 80, respectively. It should be appreciated that as used herein "at least one of A, B or C" is intended to mean A, B, C, A and B, A and C, B and C or A, B and C. In short, individually A, B or C or any combination thereof.

In some embodiments, at least one of first hollow member 64 or second hollow member 68 comprises a plurality of through holes, e.g., through holes 82, arranged in second side 84 or 86, respectively, opposite first side 78 or 80, respectively. In some embodiments, at least one of first extendible member 66 or second extendible member 70 comprises at least one through hole, e.g., through hole 88, in registered alignment with an aligned pair of through holes of the plurality of through holes in the first and second sides of at least one of the first hollow member or the second hollow member, respectively. It should be appreciated that through holes 76 and 82 include opposing paired through holes in registered alignment, i.e., the centers of opposing through holes are collinear, and through hole 88 should be aligned with through holes 76 and 82 in order to establish a lockable arrangement between first hollow member 64 and first extendible member 66 and between second hollow member 68 and first extendible member 70.

In some embodiments, chimney liner removal apparatus further comprises at least one locking pin, e.g., locking pin 90, arranged in an aligned pair of through holes of the plurality of through holes in first hollow member 64 and first extendible member 66, and/or arranged in an aligned pair of through holes of the plurality of through holes in second hollow member 68 and second extendible member 70.

In some embodiments, at least one of first extendible member 66 or second extendible member 70 comprises plunger 92 biased towards and engaged with one of the through holes of the plurality of through holes in first side 78 or 80, respectively, of at least one of first hollow member 64 or second hollow member 68. Plunger 92 may be biased by any means known in the art, e.g., spring 94. It should be appreciated that although the foregoing embodiments are described as comprising the engagement of one through hole of the plurality of through holes in first side 78 or 80, other embodiments are also possible. For example, multiple plungers 92 may engage with multiple through holes in first side 78 or 80, may engage with one of the through holes of the plurality of through holes in second side 84 or 86, or combinations thereof.

Similar to first hollow member 64 and second hollow member 68 described above, in some embodiments, third hollow member 72 comprises a plurality of through holes, e.g., through holes 96, arranged in first side 98.

In some embodiments, third hollow member 72 comprises a plurality of through holes, e.g., through holes 100, arranged in second side 102 opposite first side 98. In some embodiments, third extendible member 74 comprises at least one through hole, e.g., through hole 104, in registered alignment with an aligned pair of through holes of the plurality of through holes in first and second sides 98 and 102, respectively, of third hollow member 72. In some embodiments, liner removal apparatus 50 further comprises at least one locking pin, e.g., locking pin 106, arranged in an aligned pair of through holes of the plurality of through holes in third hollow member 72 and an aligned through hole in third extendible member 74.

In some embodiments, third extendible member 74 comprises plunger 92 biased towards and engaged with one of the through holes of the plurality of through holes in first side 98 of third hollow member 74. It should be appreciated that although the foregoing embodiments are described as comprising the engagement of one through hole of the plurality of through holes in first side 98, other embodiments are also possible. For example, multiple plungers 92 may engage with multiple through holes in first side 98, may engage with one of the through holes of the plurality of through holes in second side 102, or combinations thereof.

In some embodiments, the position of third extendible member 74 relative to third hollow member 72 is driven by a hydraulic piston (not shown). For example, a hydraulic piston may be positioned within third hollow member 72 adjacent main chassis 52. The hydraulic piston would then engage the end of third extendible member 74 closest to main chassis 52. As the hydraulic cylinder is fixed at its end nearest main chassis 52, extension and retraction of the piston will result in extension and retraction of third extendible member 74.

Figure 2:
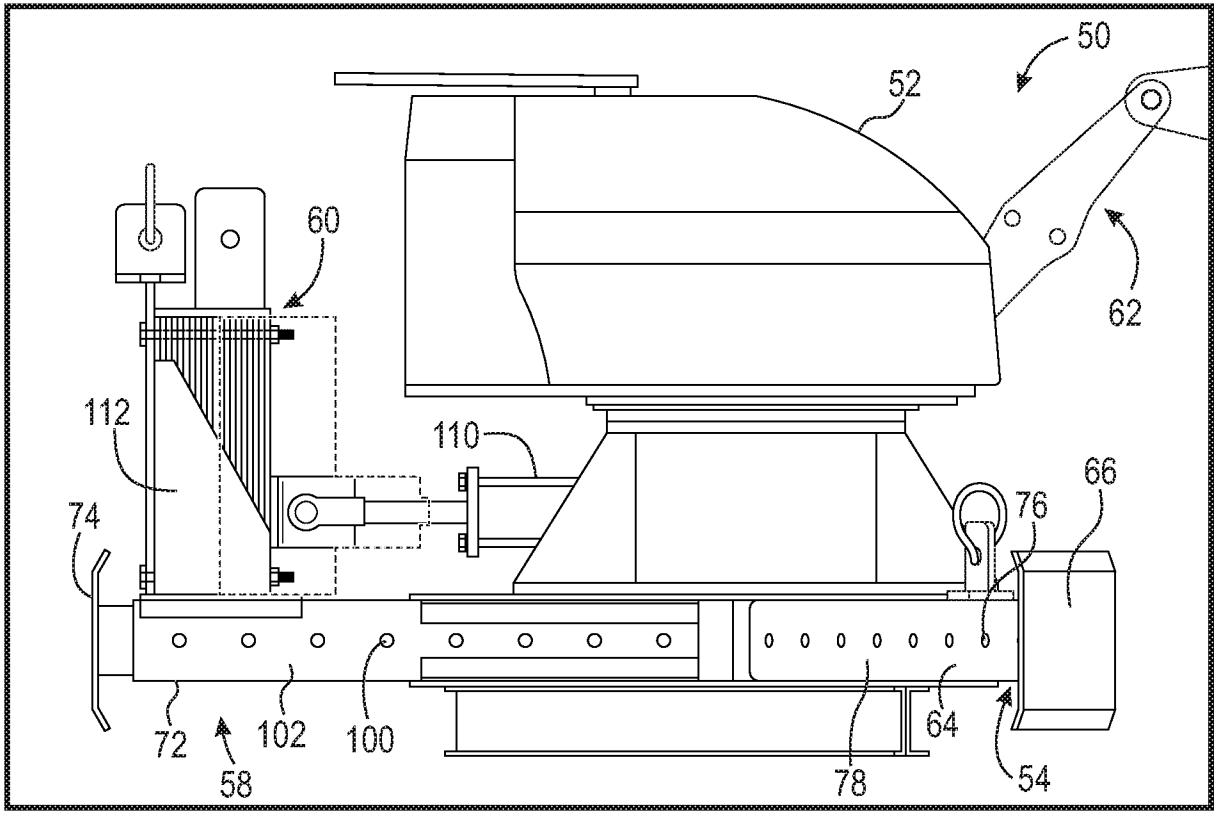
FIG. 2 is an enlarged side elevational view of an embodiment of the liner removal apparatus of FIG. 1 depicting movement of a balance mass.
Figure 3:
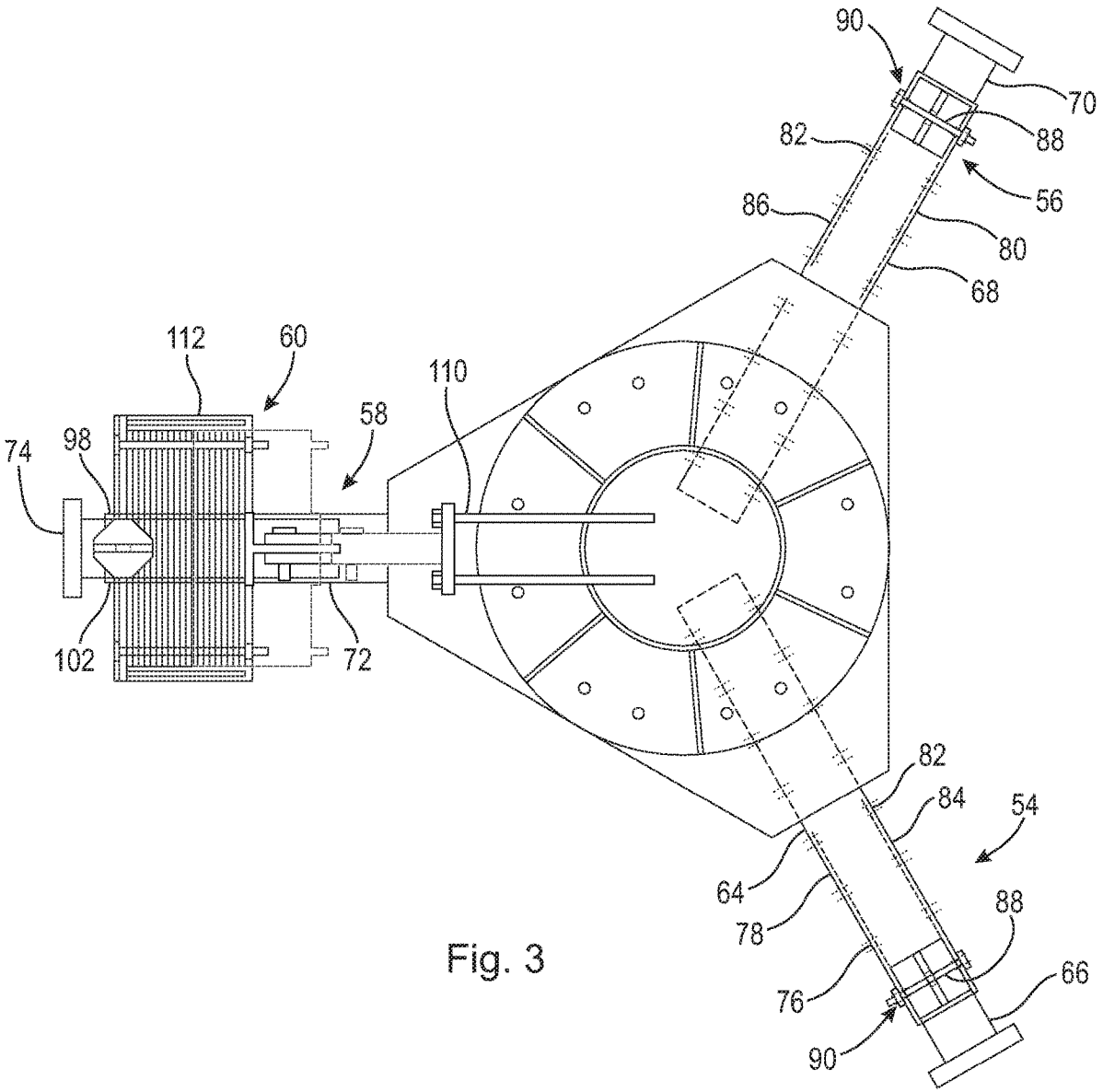
FIG. 3 is a top plan view of an embodiment of the liner removal apparatus of FIG. 1 with the main chassis and excavator assembly removed depicting movement of the balance mass.
Figure 5:
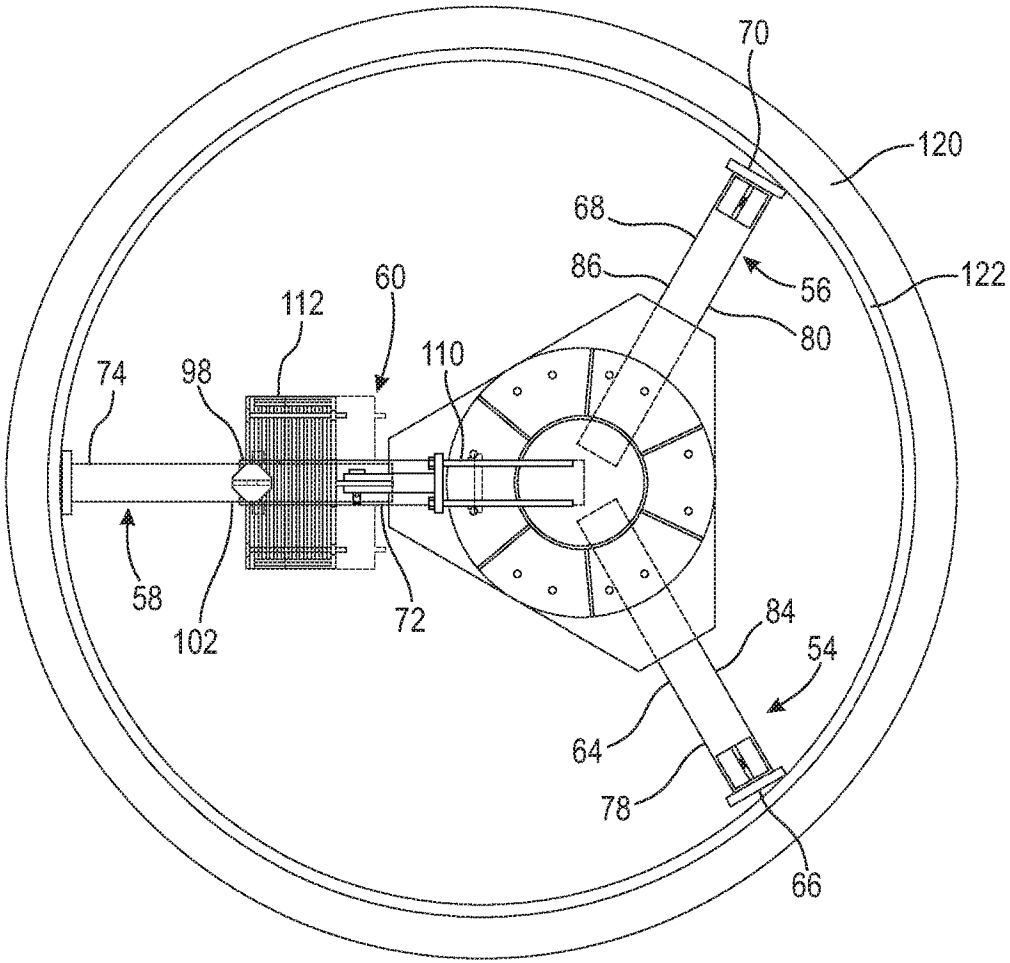
FIG. 5 is a cross sectional view of the chimney and liner removal apparatus of FIG. 4 taken generally along Line 5-5 of FIG. 4 having the main chassis and excavator assembly removed.
Figure 4:
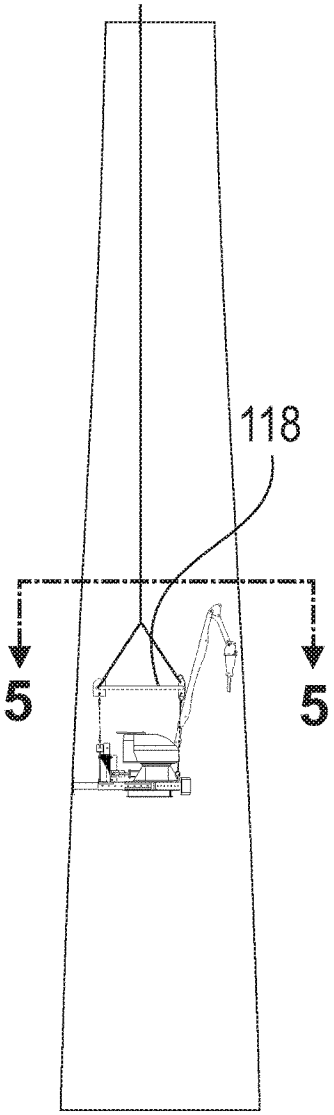
FIG. 4 is a side elevational view of a chimney including an embodiment of a present invention liner removal apparatus held therein by a lifting apparatus.
Figure 6:
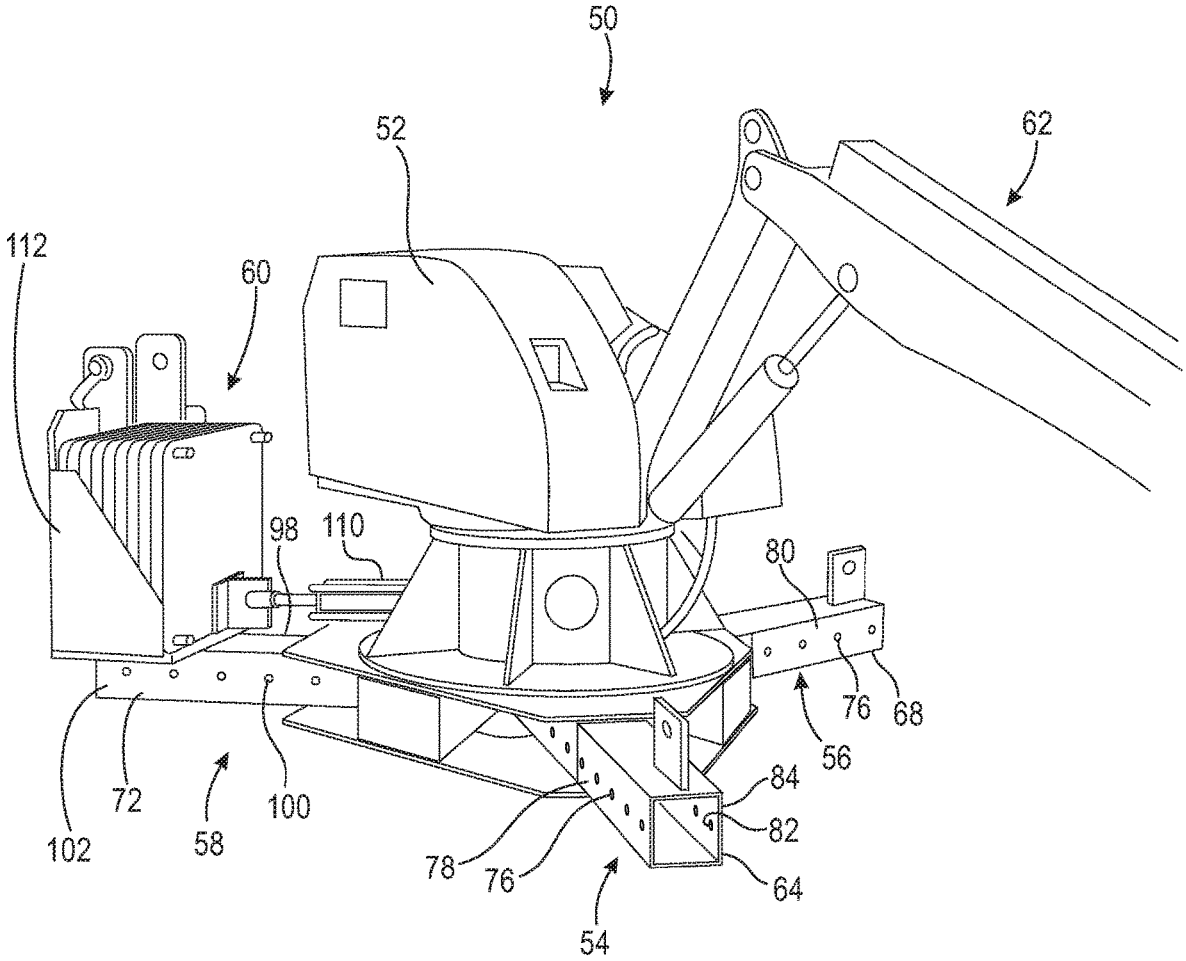
FIG. 6 is a perspective view of an embodiment of a present invention liner removal apparatus with the extendible members removed.
Figure 7:
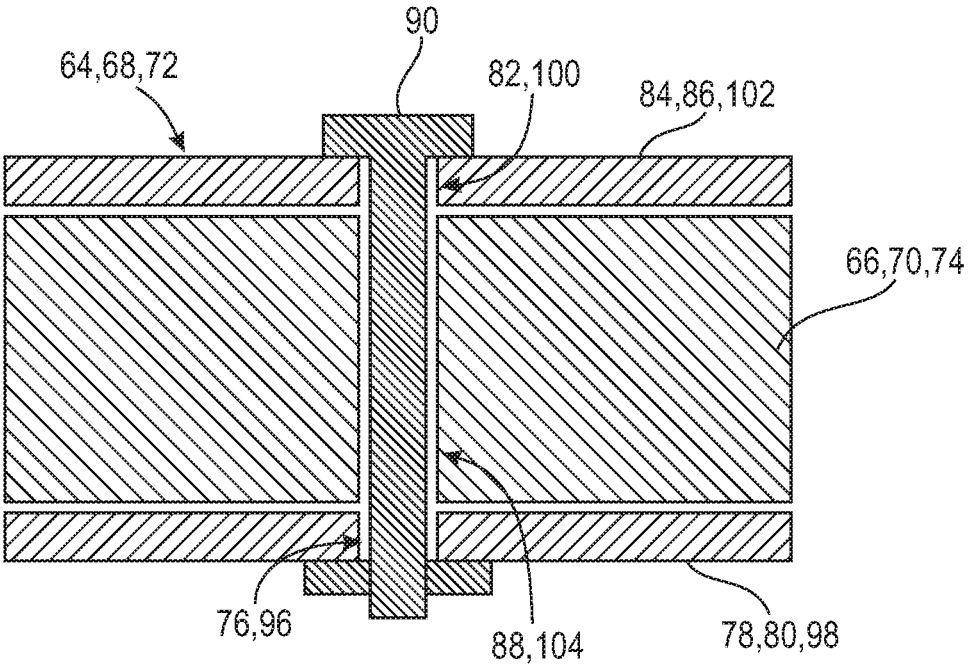
FIG. 7 is a partial cross sectional view of an embodiment of an extendible arm of a present liner removal apparatus having a locking pin; and, FIG. 8 is a partial cross sectional view of an embodiment of an extendible arm of a present liner removal apparatus having biased locking members.
Figure 8:
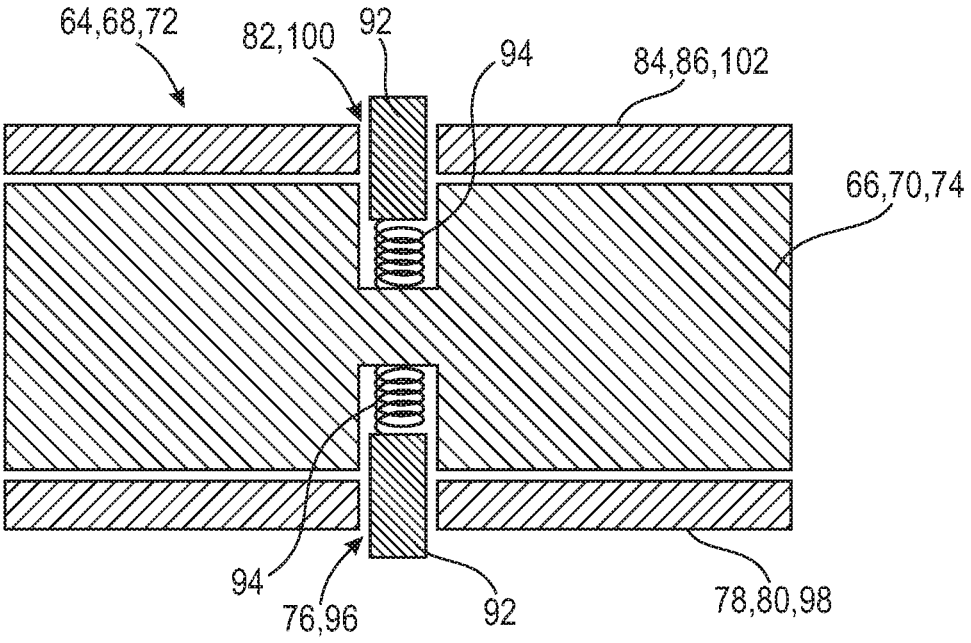

In some embodiments, movable mass 60 linearly translates towards and away from main chassis 52 to maintain a center of gravity of liner removal apparatus 50 approximately located at the center point of main chassis 52. The foregoing movement is shown generally with a broken line depiction of balance mass 60 in FIGS. 1, 2, 3 and 5. The center point of main chassis 52 is positioned approximately on broken line 108. In some embodiments, chimney liner removal apparatus 50 further comprises hydraulic cylinder 110 arranged to linearly translate movable mass 60. In some embodiments, liner removal apparatus 50 further comprises partial enclosure 112 fixedly secured to third hollow member 72 and arranged to contain movable mass 60.

Thus, it should be appreciated that the location of the center of gravity of liner removal apparatus 50 changes when any of the following occurs: extension or retraction of first telescoping arm 54; extension or retraction of second telescoping arm 56; extension or retraction of rear telescoping arm 58; movement of balance mass 60; and, extension, retraction or repositioning of extendible excavator assembly 62. During any of the foregoing events, alone or in combination, the position of broken line 108, i.e., the location of the center of gravity, will change as depicted by arrows 114 and 116.

In some embodiments, liner removal apparatus 50 comprises main chassis 52, first front arm 54 fixedly connected to main chassis 52, second front arm 56 fixedly connected to main chassis 52, rear telescoping arm 58, movable mass 60 and extendible excavator assembly 62. Rear telescoping arm 58 is fixedly connected to main chassis 52 and comprises hollow member 72 and extendible member 74 within hollow member 72. Movable balance mass 60 is arranged on hollow member 72. Extendible excavator assembly 62 is pivotally connected to main chassis 52 opposite rear telescoping arm 58.

It should be appreciated that in some embodiments the front arms may be fixed in length and therefore not extendible. Although, the front arms are fixed lengths in some embodiments, the rear arm remains extendible, and alone or in combination with the extendible excavator assembly, alter the center of gravity of the apparatus towards and away from the rear arm. Thus, the movable mass is still necessary to maintain the center of gravity of the apparatus.

It should be appreciated that the disclosed embodiments of the present liner removal apparatus set forth herein provide an apparatus for safely and effectively removing a liner. The liner removal apparatus may be lowered within a structure using spreader beam 118 which connects liner removal apparatus 50 to a crane or other lifting device. After lowering apparatus 50 within structure 120, apparatus 50 is used to remove liner 122 as part of a maintenance protocol for structure 120.

The foregoing embodiments may be controlled by an operator located above the apparatus on a separate platform, for example. Alternatively, the present liner removal apparatus may rely upon cameras, either directly mounted on the apparatus or proximate apparatus, to transmit video images of the apparatus to an operator to provide real time feedback of the operation of the apparatus.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

We claim:

1. A chimney liner removal apparatus, comprising:

a main chassis;

a first telescoping front arm fixedly connected to the main chassis and comprising a first hollow member and a first extendible member within the first hollow member;

a second telescoping front arm fixedly connected to the main chassis and comprising a second hollow member and a second extendible member within the second hollow member;

a rear telescoping arm fixedly connected to the main chassis and comprising a third hollow member and a third extendible member within the third hollow member;

a movable balance mass arranged on the third hollow member; and, an extendible excavator assembly pivotally connected to the main chassis opposite the rear telescoping arm.

2. The chimney liner removal apparatus of claim 1, wherein at least one of the first hollow member or the second hollow member comprises a plurality of through holes arranged in a first side.

3. The chimney liner removal apparatus of claim 2, wherein at least one of the first hollow member or the second hollow member comprises a plurality of through holes arranged in a second side opposite the first side.

4. The chimney liner removal apparatus of claim 3, wherein at least one of the first extendible member or the second extendible member comprises at least one plunger biased towards and engaged with at least one through hole of the plurality of through holes in the first side of at least one of the first hollow member or the second hollow member and/or biased towards and engaged with at least one through hole of the plurality of through holes in the second side of at least one of the first hollow member or the second hollow member.

5. The chimney liner removal apparatus of claim 3, wherein at least one of the first extendible member or the second extendible member comprises at least one through hole in registered alignment with an aligned pair of through holes of the plurality of through holes in the first and second sides of at least one of the first hollow member or the second hollow member, respectively.

6. The chimney liner removal apparatus of claim 5, further comprising:

at least one locking pin arranged in an aligned pair of through holes of the plurality of through holes in the first hollow member and the first extendible member, and/or arranged in an aligned pair of through holes of the plurality of through holes in the second hollow member and the second extendible member.

7. The chimney liner removal apparatus of claim 2, wherein at least one of the first extendible member or the second extendible member comprises at least one plunger biased towards and engaged with at least one through hole of the plurality of through holes in the first side of at least one of the first hollow member or the second hollow member.

8. The chimney liner removal apparatus of claim 1, wherein the third hollow member comprises a plurality of through holes arranged in a first side.

9. The chimney liner removal apparatus of claim 8, wherein the third hollow member comprises a plurality of through holes arranged in a second side opposite the first side.

10. The chimney liner removal apparatus of claim 9, wherein the third extendible member comprises at least one plunger biased towards and engaged with at least one through hole of the plurality of through holes in the first side of the third hollow member and/or biased towards and engaged with at least one through hole of the plurality of through holes in the second side of the third hollow member.

11. The chimney liner removal apparatus of claim 9, wherein the third extendible member comprises at least one through hole in registered alignment with an aligned pair of through holes of the plurality of through holes in the first and second sides of the third hollow member.

12. The chimney liner removal apparatus of claim 11, further comprising:

at least one locking pin arranged in a through hole of the plurality of through holes in the third hollow member and the third extendible member.

13. The chimney liner removal apparatus of claim 8, wherein the third extendible member comprises at least one plunger biased towards and engaged with at least one through hole of the plurality of through holes in the first side of the third hollow member.

14. The chimney liner removal apparatus of claim 1, wherein a position of the third extendible member relative to the third hollow member is driven by a hydraulic piston.

15. The chimney liner removal apparatus of claim 1, wherein the movable balance mass linearly translates towards and away from the main chassis to maintain a center of gravity of the chimney liner removal apparatus approximately located at a center point of the main chassis.

16. The chimney liner removal apparatus of claim 1, further comprising:

a hydraulic cylinder arranged to linearly translate the movable balance mass.

17. The chimney liner removal apparatus of claim 16, wherein the movable balance mass linearly translates towards and away from the main chassis to maintain a center of gravity of the chimney liner removal apparatus approximately located at a center point of the main chassis.

18. The chimney liner removal apparatus of claim 1, further comprising:

a partial enclosure fixedly secured to the third hollow member and arranged to contain the movable balance mass.

19. The chimney liner removal apparatus of claim 18, wherein the movable balance mass linearly translates within the partial enclosure towards and away from the main chassis to maintain a center of gravity of the chimney liner removal apparatus approximately located at a center point of the main chassis.

20. A chimney liner removal apparatus, comprising:

a main chassis;

a first front arm fixedly connected to the main chassis;

a second front arm fixedly connected to the main chassis;

a rear telescoping arm fixedly connected to the main chassis and comprising a first hollow member and a first extendible member within the first hollow member;

a movable balance mass arranged on the first hollow member; and, an extendible excavator assembly pivotally connected to the main chassis opposite the rear telescoping arm.

* * * * *